US011161585B2

(12) United States Patent
Iwaki et al.

(10) Patent No.: US 11,161,585 B2
(45) Date of Patent: Nov. 2, 2021

(54) BOAT

(71) Applicant: YAMAHA HATSUDOKI KABUSHIKI KAISHA, Iwata (JP)

(72) Inventors: Ryutaro Iwaki, Shizuoka (JP); Masaru Suzuki, Shizuoka (JP); Shingo Igarashi, Shizuoka (JP); Sumihiro Takashima, Shizuoka (JP); Naoki Kinomoto, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 311 days.

(21) Appl. No.: 16/531,153

(22) Filed: Aug. 5, 2019

(65) Prior Publication Data

US 2020/0039624 A1 Feb. 6, 2020

(30) Foreign Application Priority Data

Aug. 6, 2018 (JP) ..... JP2018-147742

(51) Int. Cl.
*B63H 25/42* (2006.01)
*B63H 21/21* (2006.01)

(52) U.S. Cl.
CPC ..... *B63H 21/21* (2013.01); *B63H 2021/216* (2013.01)

(58) Field of Classification Search
CPC .. B63H 25/02; B63H 25/42; B63H 2025/045; B63H 20/00; B63H 20/12; B63H 21/213; B63H 21/22; B63H 25/04; B63H 5/125; B63H 11/00; B63H 11/04; B63H 11/101; B63H 11/113; B63H 2021/216; B63H 2025/026; B63H 2025/465; B63H 21/14; B63H 21/21; B63H 25/46; F02B 61/045; F02D 41/042; F02D 41/2406; F02D 41/249; G05D 1/0206; G05D 1/0875; G06F 12/0246; H02J 7/1461; H02J 7/1476; B63B 34/10
See application file for complete search history.

(56) References Cited

U.S. PATENT DOCUMENTS 10,562,602 B1 * 2/2020 Gable ..... B63H 25/46
2003/0076071 A1 * 4/2003 Kanno ..... H02J 7/1476 320/132
2005/0199167 A1 * 9/2005 Mizutani ..... B63H 25/02 114/144 R (Continued)

FOREIGN PATENT DOCUMENTS

JP 2013-86668 A 5/2013

OTHER PUBLICATIONS

Liu et al., Remote control of a robotic boat via the Internet, 2005, IEEE, p. 548-553 (Year: 2005).*

(Continued)

*Primary Examiner* — McDieunel Marc
(74) *Attorney, Agent, or Firm* — Keating and Bennett, LLP

(57) ABSTRACT

A boat includes an engine, an input that receives an input operation performed by an operator, and a controller connected to the input. The controller is powered off when the input does not receive the input operation within a first length of time after the engine is stopped. The controller is not powered off when the input receives the input operation within the first length of time after the engine is stopped.

12 Claims, 5 Drawing Sheets

(56) References Cited

U.S. PATENT DOCUMENTS

| | | | | |
|---|---|---|---|---|
| 2007/0178779 | A1* | 8/2007 | Takada | B63H 20/12 440/61 S |
| 2008/0115712 | A1* | 5/2008 | Hiroshima | B63H 21/213 114/144 RE |
| 2013/0102206 | A1 | 4/2013 | Fujino et al. | |
| 2013/0254468 | A1* | 9/2013 | Miyaki | F02D 41/042 711/103 |
| 2016/0189439 | A1* | 6/2016 | Vetterick | G06Q 30/0261 701/29.4 |

OTHER PUBLICATIONS

Zhou et al., The design and application of an unmanned surface vehicle powered by solar and wind energy, 2015, IEEE, p. 1-10 (Year: 2015).*

Prempraneerach et al., Autonomous way-point tracking navigation of surveying surface vessel with real-time positioning system, 2015, IEEE, p. 1-6 (Year: 2015).*

Rogers, Preventing recreational boating fatalities and serious injuries with: The ANN (Assistant Naval Navigator) System Enterprise, 2014, IEEE, p. 1-7 (Year: 2014).*

* cited by examiner

BOAT

CROSS REFERENCE TO RELATED APPLICATIONS

This application claims the benefit of priority to Japanese Patent Application No. 2018-147742 filed on Aug. 6, 2018. The entire contents of this application are hereby incorporated herein by reference.

BACKGROUND OF THE INVENTION

1. Field of the Invention

The present invention relates to a boat.

2. Description of the Related Art

A type of boat conventionally known includes a controller (ECU: engine control unit) for controlling an engine and a display connected to the controller (see Japan Laid-open Patent Application Publication No. 2013-86668). The display displays a variety of information including velocity, battery voltage and remaining fuel amount.

Incidentally, when the display is configured to receive an input operation performed by an operator, the display is usable as an input whereby a display mode of the display, a control mode of the engine, and a lock mode of the engine, and so forth are settable easily and conveniently. In this regard, the display configuration is useful.

In consideration of convenience of the operator, it is preferable to make the input operable by the operator not only during actuation of the engine but also after the engine is stopped. However, in order to inhibit battery consumption, the ECU is required to be powered off at a point of time when a predetermined length of time elapses after the engine is stopped.

Despite this, chances are that the operator is interrupted from performing the input operation by powering off the ECU at the point in time when the predetermined length of time elapses after the engine is stopped.

SUMMARY OF THE INVENTION

Preferred embodiments of the present invention provide boats that enhance the performance of an input operation by an operator.

A boat according to a preferred embodiment of the present invention includes an engine, an input that receives an input operation performed by an operator of the boat, and a controller connected to the input. The controller is powered off when the input does not receive the input operation within a first length of time after the engine is stopped. The controller is not powered off when the input receives the input operation within the first length of time after the engine is stopped.

According to preferred embodiments of the present invention, boats that enhance the performance of an input operation by an operator are provided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Boats according to preferred embodiments of the present invention will be hereinafter explained with reference to drawings.

Figure 1:
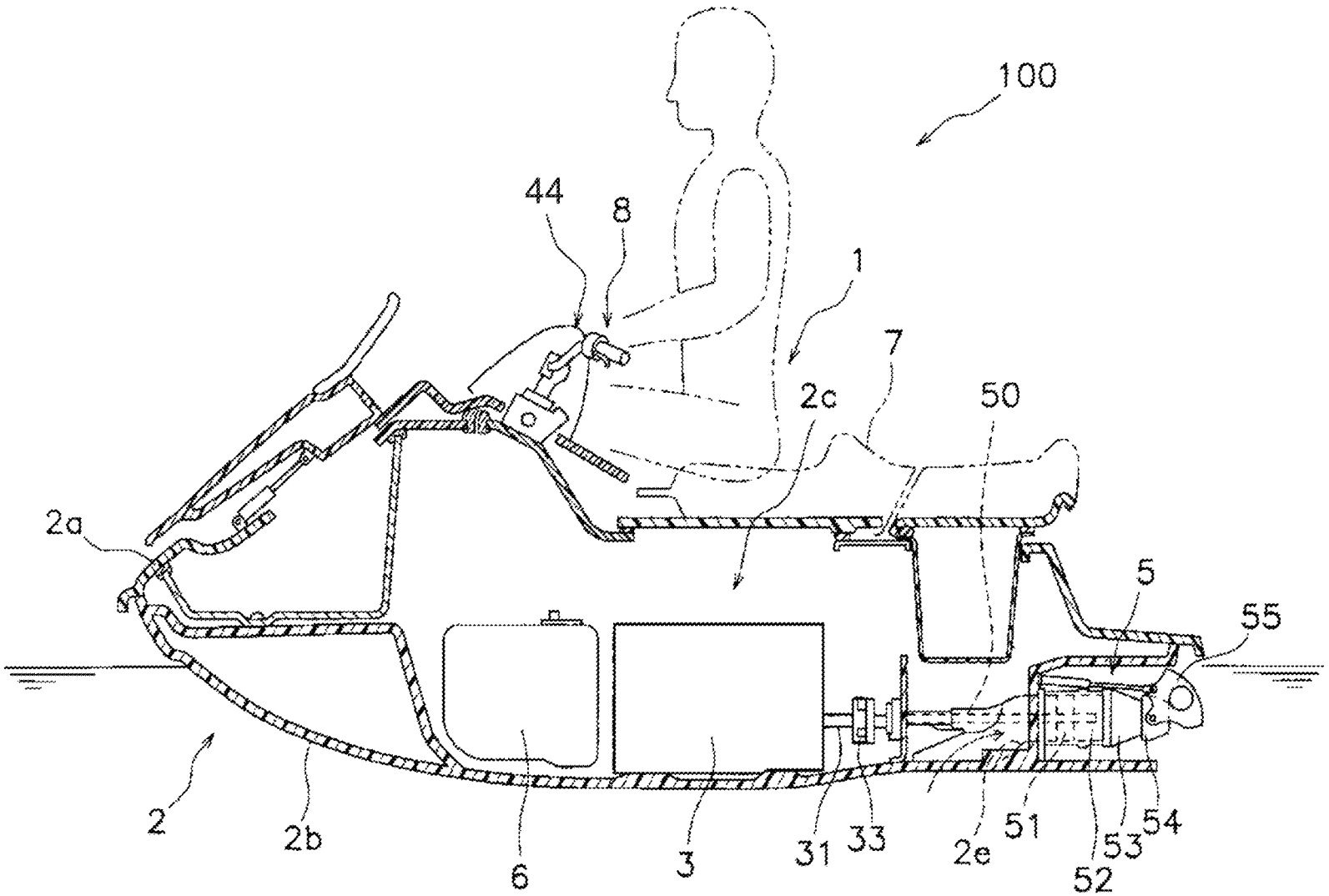
FIG. 1 is a cross-sectional view of an entire configuration of a boat according to a preferred embodiment of the present invention.
Figure 2:
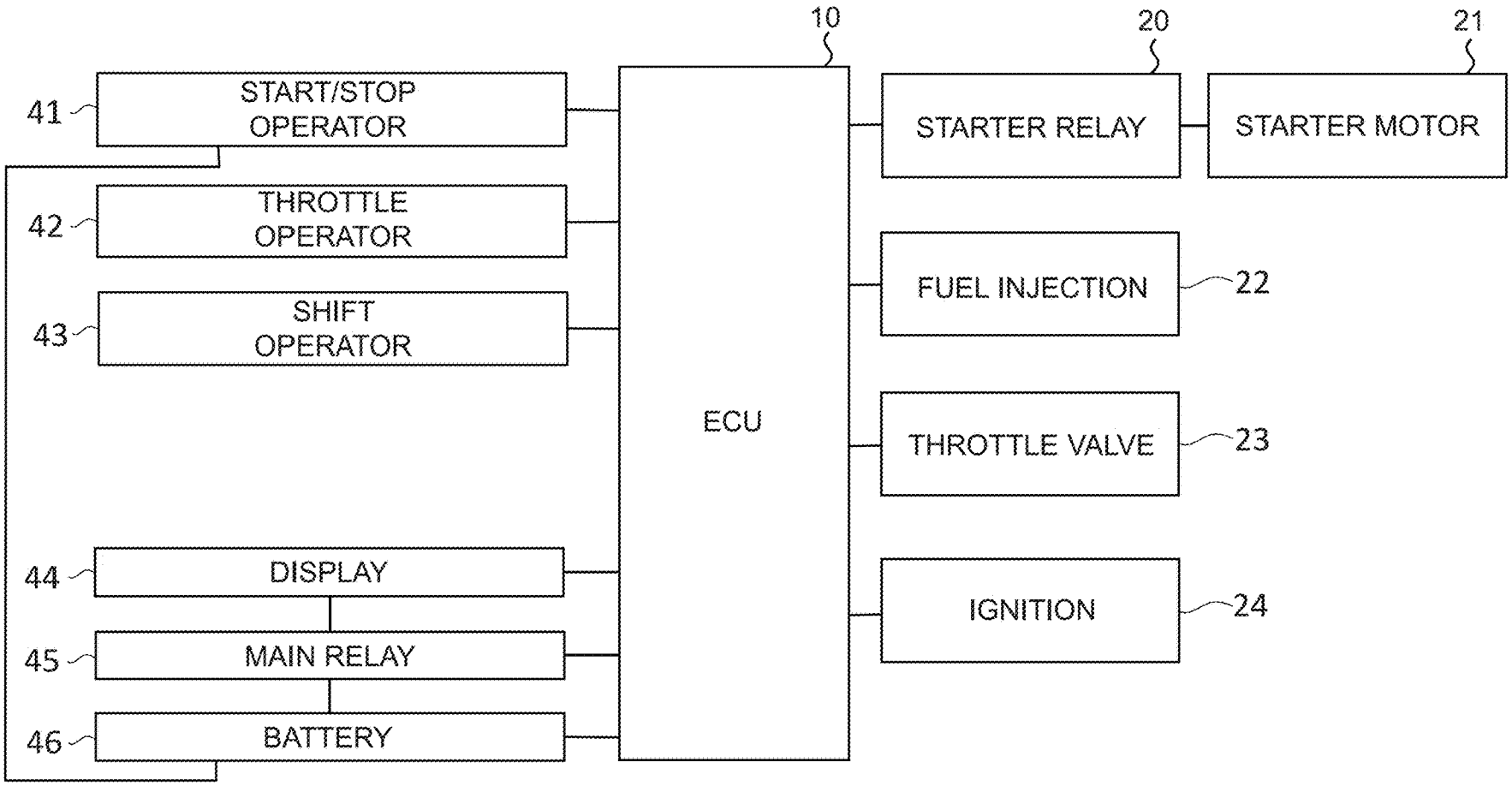
FIG. 2 is a block diagram of a control system of the boat.

FIG. 1 is a cross-sectional view of an entire configuration of a boat 100 according to a preferred embodiment of the present invention. FIG. 2 is a block diagram of a control system of the boat 100. The boat 100 is, for example, a so-called personal watercraft (PWC). The boat 100 includes a watercraft unit 1 shown in FIG. 1 and an ECU (Engine Control Unit) 10 shown in FIG. 2.

As shown in FIG. 1, the watercraft unit 1 includes a vessel body 2, an engine 3, and a jet propulsion device 5. The vessel body 2 includes a deck 2*a* and a hull 2*b*. The vessel body 2 is provided with an engine room 2*c* in the interior thereof. The engine room 2*c* accommodates the engine 3, a fuel tank 6 and so forth. A seat 7 is attached to the deck 2*a*. The seat 7 is disposed directly above the engine 3. A steering 8 is disposed in front of the seat 7 in order to steer the vessel body 2.

The engine 3 is, for instance, an inline four-cylinder four-stroke engine. The engine 3 includes a crankshaft 31. The crankshaft 31 extends in the back-and-forth direction. As shown in FIG. 2, the watercraft unit 1 includes a starter relay 20, a starter motor 21, fuel injections 22, at least one throttle valve 23, and ignitions 24. The starter relay 20 is turned on/off by the ECU 10. When the starter relay 20 is turned on, the starter motor 21 is supplied with electric power. The starter motor 21 starts the engine 3 when supplied with the electric power from the starter relay 20. Each fuel injection 22 injects fuel into a combustion chamber of the engine 3. The amount of mixed gas to be fed to the combustion chamber is regulated by changing the opening degree of the at least one throttle valve 23. Each ignition 24 ignites the fuel inside the combustion chamber. It should be noted that, although not shown in FIG. 2, each of the plurality of cylinders of the engine 3 is provided with a fuel injection 22 and an ignition 24. A single throttle valve 23 may be provided commonly for the plurality of cylinders of the engine 3, or alternatively, a plurality of throttle valves 23 may be provided for the plurality of cylinders of the engine 3, respectively.

The jet propulsion device 5 is driven by the engine 3, and sucks in and spouts water to the surroundings of the vessel body 2. As shown in FIG. 1, the jet propulsion device 5 includes an impeller shaft 50, an impeller 51, an impeller housing 52, a nozzle 53, a deflector 54, and a reverse bucket 55. The impeller shaft 50 extends rearward from the engine room 2*c*. The front portion of the impeller shaft 50 is coupled to the crankshaft 31 through a coupling 33. The rear portion of the impeller shaft 50 extends into the impeller housing 52 through a water suction portion 2*e* of the vessel body 2. The impeller housing 52 is connected to the rear portion of the water suction portion 2*e*. The nozzle 53 is disposed behind the impeller housing 52.

The impeller 51 is attached to the rear portion of the impeller shaft 50. The impeller 51 is disposed in the interior of the impeller housing 52. The impeller 51 is rotated together with the impeller shaft 50 so as to suck in water through the water suction portion 2*e*. The impeller 51 rearwardly spouts the sucked in water through the nozzle 53. The deflector 54 is disposed behind the nozzle 53. The deflector 54 is configured to change the direction of water spouted from the nozzle 53 in the right-and-left direction. The reverse bucket 55 is disposed behind the deflector 54. The reverse bucket 55 is configured to change the direction of water spouted from the nozzle 53 and the deflector 54 to the fore direction.

As shown in FIG. 2, the watercraft unit 1 includes a plurality of operators such as a start/stop operator 41, a throttle operator 42, and a shift operator 43. The operators are operated by an operator of the watercraft unit 1. The start/stop operator 41 is an operator that starts and stops the engine 3. The start/stop operator 41 is, for instance, a switch. The start/stop operator 41 is electrically connected to each of the ECU 10 and a battery 46. The throttle operator 42 is an operator that increases and decreases the engine rotational speed. The throttle operator 42 increases and decreases the engine rotational speed by controlling the opening degree of the at least one throttle valve 23. The throttle operator 42 is, for instance, a throttle lever. The shift operator 43 is an operator that switches between forward movement and backward movement of the watercraft unit 1. The shift operator 43 switches between forward movement and backward movement of the watercraft unit 1 by operating the position of the reverse bucket 55. The shift operator 43 is, for instance, a shift lever.

As shown in FIGS. 1 and 2, the watercraft unit 1 includes a display 44. The display 44 functions not only as "a display" that displays a variety of information regarding the boat 100 but also as "an input" that receives an input operation performed by the operator. The display 44 is typically a touchscreen display, for example. The display 44 is able to detect a touch operation performed by the operator. Additionally, the display 44 is embedded with a counter, and is able to count time elapsing from a predetermined time.

In the present preferred embodiment, the display 44 receives input operations performed by the operator to set a display mode of the display 44, a control mode of the engine 3, and a lock mode of the engine 3. For example, in the display mode of the display 44, the operator is able to switch between units of velocity to be displayed, between designs to be displayed, between colors to be displayed, and between information to be displayed, and so forth. In the control mode of the engine 3, the operator is able to switch between maximum speeds, between maximum outputs, between acceleration characteristics, and so forth. In the lock mode of the engine 3, the operator is able to set either a locked state or an unlocked state.

In the present preferred embodiment, the display 44 receives the input operation to set the display mode during stoppage of the engine 3, during idling of the engine 3, and during operation of the engine 3. The display 44 receives the input operation to set the control mode of the engine 3 during stoppage of the engine 3 and during idling of the engine 3. The display 44 receives the input operation to set the lock mode of the engine 3 during stoppage of the engine 3 and during idling executed within a predetermined length of time (e.g., about 0.7 seconds) from the start of the engine 3.

Based on the above-described input operations performed by the operator, the display 44 generates an operating signal that contains information of the control mode of the engine 3 and information of the lock mode of the engine 3. The display 44 rewrites the operating signal every time the control mode of the engine 3 and the lock mode of the engine 3 are changed by the input operations performed by the operator. The display 44 outputs an operating signal to the ECU 10 at intervals of time Tx (e.g., about 0.05 seconds). The display 44 continues to output the operating signal to the ECU 10 at the intervals of time Tx unless the display 44 has not transitioned to a sleep state after being powered on. On the other hand, when having transitioned to the sleep state, or when having been forcibly powered off, the display 44 stops outputting the operating signal to the ECU 10.

Figure 3:
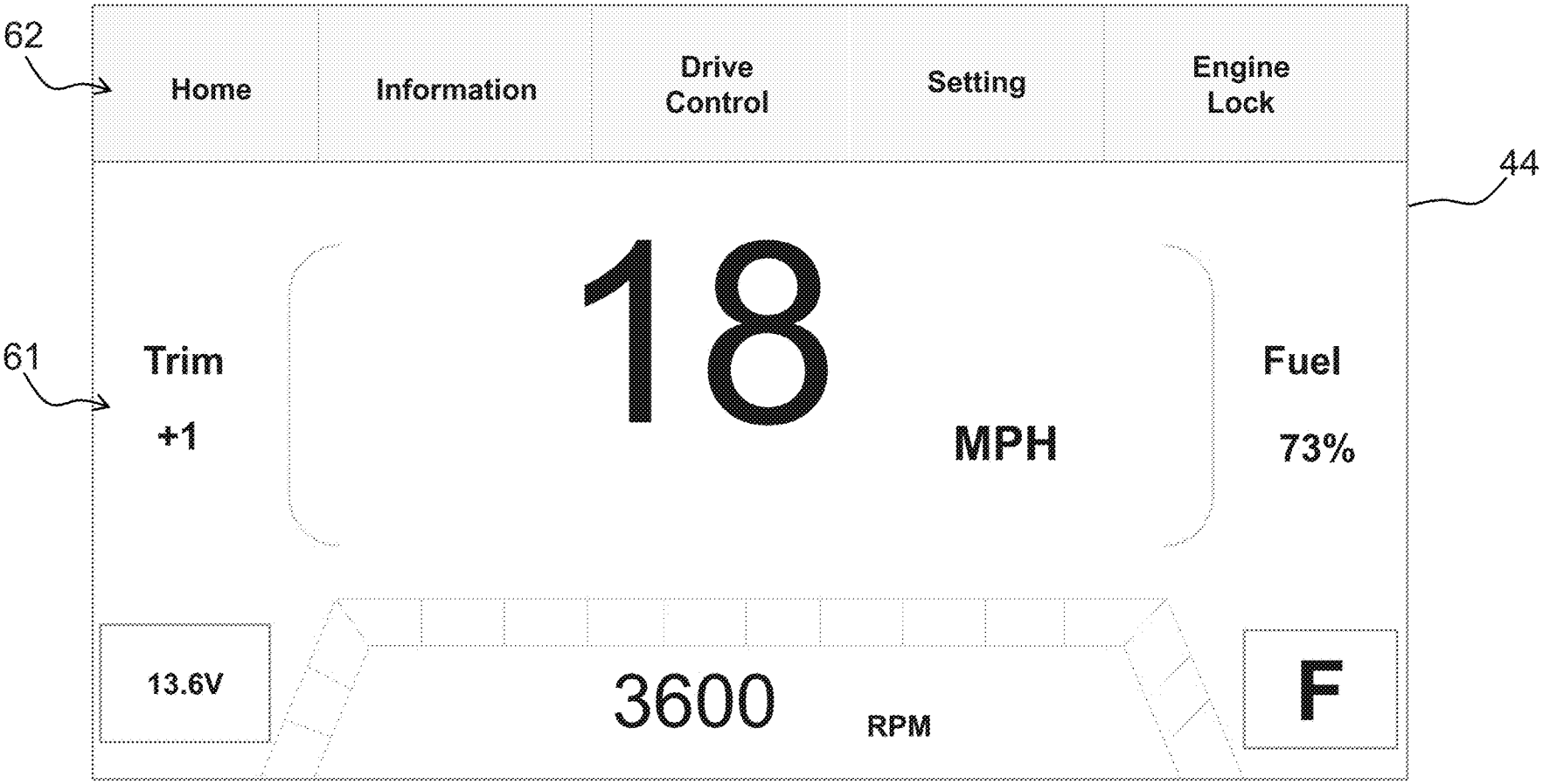
FIG. 3 shows an example of a screen displayed on a display according to a preferred embodiment of the present invention.

FIG. 3 is an example of a screen displayed on the display 44. The display 44 includes a first display 61 and a second display 62. The first display 61 is disposed directly below the second display 62. The first display 61 displays the velocity of the watercraft unit 1, the rotational speed of the engine 3, the trim angle of the nozzle 53, the remaining amount of fuel, the voltmeter of the battery 46 to be described below, the operating position of the shift operator 43, and so forth. The second display 62 displays a home button, an information button, a drive control button, a setting button, and an engine lock button. When any of the buttons displayed on the second display 62 is touched by the operator, information related to the touched button is displayed on the first display 61. For example, when the setting button is touched by the operator, a switching button for the display mode of the display 44, a switching button for the control mode of the engine 3, and so forth are displayed on the first display 61. The operator is able to suitably change the display mode of the display 44, the control mode of the engine 3, and so forth by the switching buttons. On the other hand, when the engine lock button is touched by the operator, a switching button for the lock mode of the engine 3 is displayed on the first display portion 61. The operator is able to set the lock mode of the engine 3 to either the locked state or the unlocked state by the switching button. Thus, the display 44 has a function as "a key" of the engine 3 as well.

As shown in FIG. 2, the watercraft unit 1 includes a main relay 45 and the battery 46. The main relay 45 is electrically connected to each of the ECU 10, the display 44, and the battery 46. The main relay 45 is turned on/off by the ECU 10. When the main relay 45 is turned on, the electric power of the battery 46 is supplied to each of the ECU 10 and the display 44.

The ECU 10 corresponds to "a controller" in a preferred embodiment of the present invention. The ECU 10 controls the engine 3.

When the start/stop operator 41 is operated during stoppage of the engine 3, the ECU 10 is powered on by the electric power supplied thereto from the battery 46 via the start/stop operator 41, and then, causes electric current to flow through a coil embedded in the main relay 45 so as to turn on the main relay 45. Accordingly, the flow of electric power to the ECU 10 is switched from through the start/stop operator 41 to through the main relay 45, and simultaneously, the display 44 is powered on. Thus, supply of electric power to the ECU 10 results in the supply of electric power to the display 44.

The ECU 10 executes an operation to start the engine 3, while executing the operation to activate the ECU 10 and the display 44. Specifically, when the start/stop operator 41 is operated, the ECU 10 starts counting an operating time (e.g., a pressing time) of the start/stop operator 41. When the operating time of the start/stop operator 41 exceeds a predetermined length of time, the ECU 10 causes electric current to flow through a coil embedded in the starter relay 20 if the lock mode of the engine 3 is in the unlocked state. Accordingly, the starter motor 21 is driven such that the engine 3 is started.

When the start/stop operator 41 is operated during operation of the engine 3, the ECU 10 causes each fuel injection 22 to stop fuel injection. Accordingly, the engine 3 is stopped. Control to power off the ECU 10 (hereinafter referred to as "a power-off control) will be described below.

The ECU 10 obtains the operating signal from the display 44 at the intervals of time Tx. The ECU 10 controls each of the engine 3 and the display 44 based on the information (a variety of modes) contained in the operating signal.

The power-off control of the ECU 10 will be explained with reference to FIG. 4.

In step S1, each of the ECU 10 and the display 44 determines whether or not the engine 3 has been stopped in response to the start/stop operator 41 operated during actuation of the engine 3. When it is determined in step S1 that the engine 3 has not been stopped, each of the ECU 10 and the display 44 repeatedly executes the decision of step S1.

When it is determined in step S1 that the engine 3 has been stopped, the display 44 determines in step S2 whether or not time Ta has elapsed since stoppage of the engine 3. Time Ta is set to a length of time such that it is possible to inhibit occurrence of a situation that the battery 46 is excessively drained by use of the display 44 after the engine 3 is stopped. Time Ta is not limited to a particular length of time, but is set to be longer than time Tb to be described. Time Ta is settable to, for instance, about three minutes.

When it is determined in step S2 that time Ta has not elapsed yet after the engine 3 is stopped, the process proceeds to step S3. When it is determined in step S2 that time Ta has elapsed after the engine 3 is stopped, the process proceeds to step S5.

In step S3, it is determined whether or not an input operation (e.g., a touch operation) by the operator has been detected by the display 44.

When the input operation performed by the operator has been detected in step S3, the process returns to step S1. When the input operation performed by the operator has not been detected in step S3, the process proceeds to step S4.

In step S4, the display 44 determines whether or not time Tb has elapsed without detection of the input operation. Specifically, when the input operation has not been detected even once after the engine 3 is stopped, the display 44 determines whether or not time Tb has elapsed after the engine 3 is stopped. On the other hand, when the input operation has been detected at least once after the engine 3 is stopped, the display 44 determines whether or not time Tb has elapsed while the input operation has not been detected since the last input operation. Time Tb is set to a length of time such that it is possible to make sure whether or not the operator intends to perform an input operation. Time Tb is not limited to a particular length of time, but is set to be shorter than time Ta described above. For example, time Tb is settable to about 25 seconds.

When time Tb has not elapsed yet without detection of the input operation in step S4, the process returns to step S1. Contrarily, when time Tb has elapsed without detection of the input operation in step S4, the process proceeds to step S5.

In step S5, the display 44 causes itself to transition to a sleep state. Accordingly, the screen displayed on the display 44 is shut off, and simultaneously, outputting of the operating signal to the ECU 10 is stopped. Therefore, when the display 44 transitions to the sleep state, the operator is prevented from performing any input operation to the display 44.

In step S6, the ECU 10 determines whether or not the ECU 10 has received the operating signal anew from the display 44 within time Tc after previously receiving the operating signal therefrom. Time Tc is set to be longer than time Tx. Time Tx is a time interval at which the operating signal is received. Time Tc is not limited to a particular length of time, but is settable to about 0.1 seconds, for instance, wherein time Tx is about 0.05 seconds. Therefore, when the ECU 10 has not received the operating signal anew within time Tc after previously receiving the operating signal, this means that the display 44 has transitioned to the sleep state.

In step S6, when the ECU 10 has received the operating signal anew within time Tc after previously receiving the operating signal, the process returns to step S1. Contrarily in step S6, when the ECU 10 has not received the operating signal anew within time Tc after previously receiving the operating signal, the process proceeds to step S7.

In step S7, the ECU 10 turns off the main relay 45. Accordingly, each of the ECU 10 and the display 44 is powered off.

Figure 4:
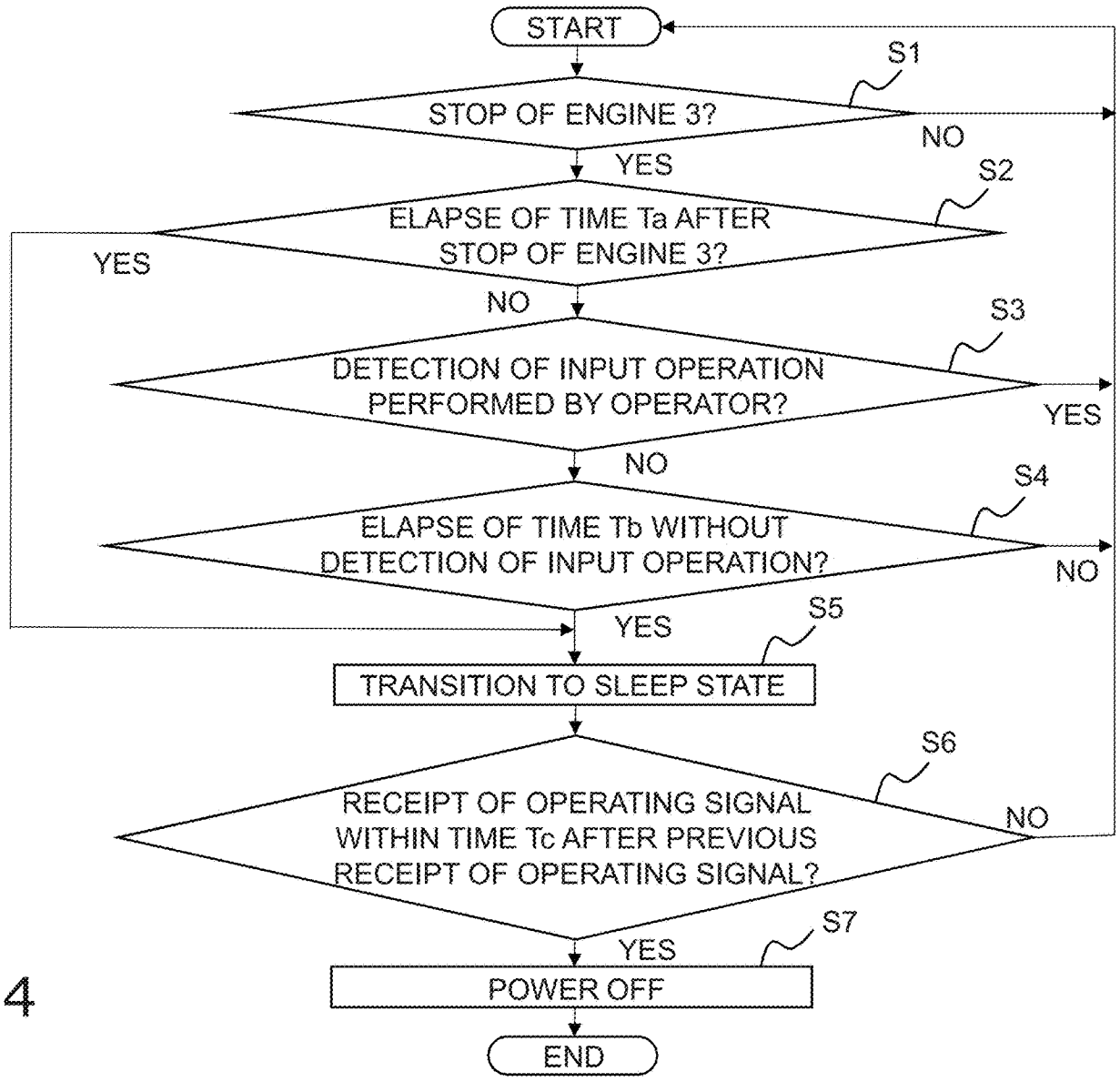
FIG. 4 is a flowchart for explaining sleep transition control for the display and powering off control for an ECU according to a preferred embodiment of the present invention.
Figure 5:
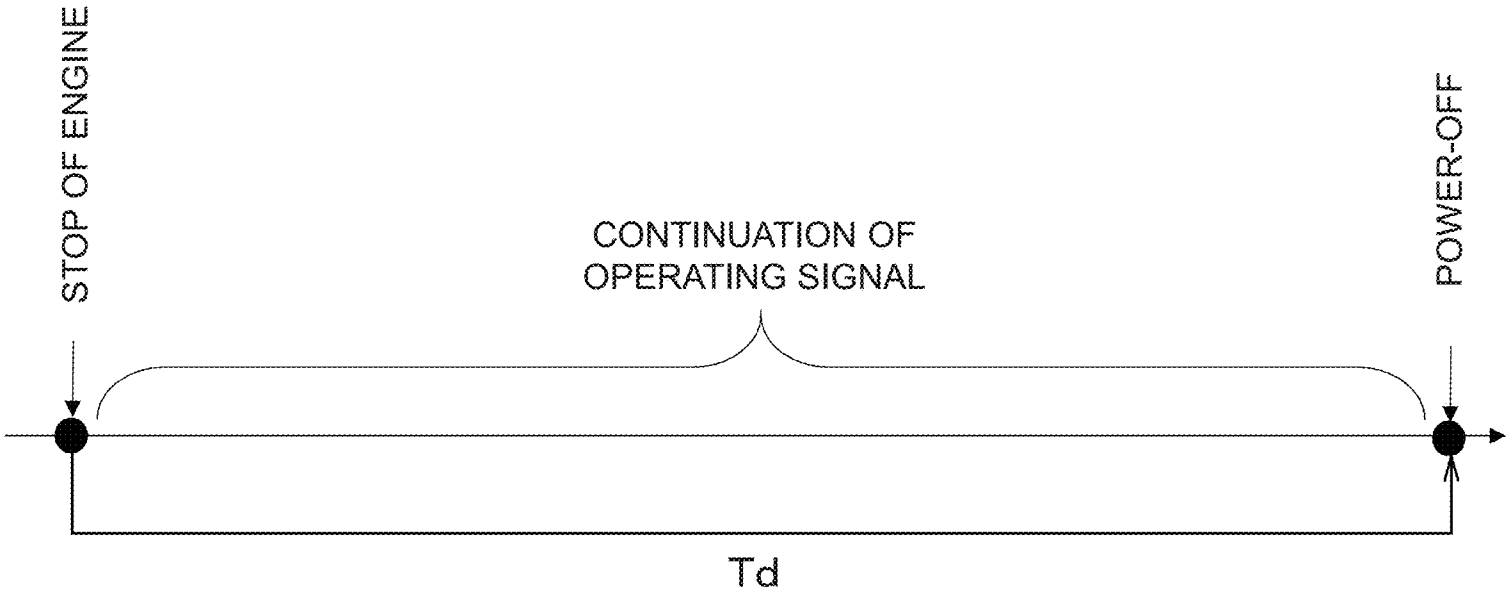
FIG. 5 is a schematic diagram for explaining a situation in which the ECU and the display are forcibly powered off.

It should be noted that although not shown in FIG. 4, the ECU 10 is powered off when the display 44 continues to output the operating signal to the ECU 10 for a long length of time after the engine 3 is stopped. Accordingly, the display 44 is forcibly powered off. Specifically, as shown in FIG. 5, the ECU 10 turns off the main relay 45 when the ECU 10 continues to receive the operating signal from the display 44 for time Td after the engine 3 is stopped. Accordingly, each of the ECU 10 and the display 44 is powered off. As a situation that each of the ECU 10 and the display 44 is thus forcibly powered off, a situation can be assumed that the display 44 has been disabled to transition to the sleep state because of a breakdown and continues to output the operating signal. Therefore, time Td is settable to a length of time long enough to make it recognizable that the display 44 has been disabled to transition to the sleep state because of a breakdown. Time Td is not limited to a particular length of time, but is set to be longer than time Tb described above. Time Td is settable to, for instance, about 5 minutes.

The ECU 10 is powered off when the display 44 (an example of "input") does not receive an input operation within time Tb (an example of "first length of time") after the engine 3 is stopped. The ECU 10 is not powered off when the display 44 receives the input operation within time Tb after the engine 3 is stopped. Therefore, it is possible to inhibit occurrence of a situation that while the operator performs an input operation, the input operation is interrupted.

The ECU 10 is powered off after the display 44 transitions to the sleep state when the display 44 does not receive the input operation within time Tb after the engine 3 is stopped. Therefore, the ECU 10 is able to be powered off in response to the display 44 having transitioned to the sleep state.

The display 44 causes itself to transition to the sleep state when time Tb elapses after the engine 3 is stopped. Therefore, processing is reduced in the ECU 10 compared to the configuration in which the ECU 10 causes the display 44 to transition to the sleep state.

The ECU 10 is powered off when time Tc (an example of "second length of time") elapses after the display 44 transitions to the sleep state. Time Tc is longer than each of the intervals of time Tx at which an operating signal is outputted from the display 44. Therefore, the ECU 10 easily and conveniently determines the time of powering off based on the operating signal not being outputted from the display 44.

The display 44 is powered off when time Ta (an example of "third length of time") elapses after the engine 3 is stopped. Therefore, the battery 46 is inhibited from being excessively drained.

As shown in FIG. 5, the ECU 10 is powered off when the ECU 10 continues to receive the operating signal from the display 44 for time Td (an example of "fourth length of time") after the engine 3 is stopped. Therefore, the ECU 10 is forcibly shut down in a situation that the display 44 has been disabled to transition to the sleep state because of a breakdown.

Preferred embodiments of the present invention have been explained above. However, the present invention is not limited to the above-described preferred embodiments, and a variety of changes can be made without departing from the gist of the present invention.

In the above-described preferred embodiments, the display 44 is configured to receive settings regarding the display mode of the display 44, the control mode of the engine 3, and the locked/unlocked mode of the engine 3. However, the display 44 may be configured to receive one or two of the above settings, or alternatively, may be configured to receive at least one setting other than the above settings.

In the above-described preferred embodiments, the display 44 is configured to cause itself to transition to the sleep state. However, the ECU 10 may be configured to cause the display 44 to transition to the sleep state.

In the above-described preferred embodiments, the display 44, which is preferably a touchscreen display, has been explained as an example of "the input". However, "the input" is not limited to this. For example, physical switches, physical buttons or so forth may be used as "the input".

In the above-described preferred embodiments, time Tc (an example of "second length of time"), which elapses until the ECU 10 is powered off after the display 44 transitions to the sleep state, is set to the same value in the respective situations. However, time Tc may be set to different values in the respective situations.

In the above-described preferred embodiments, the boat 100 is configured to include only one input (i.e., the display 44). However, the boat 100 may include two inputs. Specifically, the boat 100 may include a first input, a second input, and a main controller. The first input includes a first controller and receives a first input operation performed by an operator. The second input includes a second controller and receives a second input operation performed by the operator. The main controller is connected to the first input and the second input. In this configuration, the first controller and the second controller are connected to each other. The main controller is powered off when the second input does not receive the second input operation for a first length of time (i.e., time Tb) after the engine 3 is stopped. The main controller is not powered off when the second input receives the second input operation for the first length of time after the engine 3 is stopped.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A boat comprising:

an engine;

an input configured or programmed to receive an input operation performed by an operator of the boat; and a controller connected to the input; wherein the controller is configured or programmed to be powered off when the input does not receive the input operation within a first length of time after the engine is stopped; and the controller is configured or programmed not to be powered off when the input receives the input operation within the first length of time after the engine is stopped.

2. The boat according to claim 1, wherein the controller is configured or programmed to be powered off after the input transitions to a sleep state when the input does not receive the input operation within the first length of time after the engine is stopped.

3. The boat according to claim 2, wherein the input is configured or programmed to cause itself transition to the sleep state when the input does not receive the input operation within the first length of time after the engine is stopped.

4. The boat according to claim 2, wherein the controller is configured or programmed to cause the input to transition to the sleep state when the input does not receive the input operation within the first length of time after the engine is stopped.

5. The boat according to claim 2, wherein the controller is configured or programmed to be powered off when a second length of time elapses after the input transitions to the sleep state.

6. The boat according to claim 5, wherein the input outputs an operating signal generated based on the input operation to the controller at predetermined intervals of time; and the second length of time is longer than each of the predetermined intervals of time.

7. The boat according to claim 1, wherein the controller is configured or programmed to be powered off when a third length of time longer than the first length of time elapses after the engine is stopped.

8. The boat according to claim 1, wherein the controller is configured or programmed to be powered off when the controller continues to receive an operating signal generated based on the input operation from the input for a fourth length of time longer than the first length of time after the engine is stopped.

9. The boat according to claim 1, wherein the input is configured or programmed to generate an operating signal based on the input operation; and the operating signal includes information related to at least one of a display mode of the input, a control mode of the engine, and a locked/unlocked mode of the engine.

10. The boat according to claim 1, further comprising:

a battery; and a main relay connected to the battery, the input, and the controller; wherein the controller is configured or programmed to supply electric power to the input from the battery through the main relay.

11. The boat according to claim 1, wherein the input includes a touchscreen display.

12. A boat comprising:

an engine;

a first input including a first controller and configured or programmed to receive a first input operation performed by an operator of the boat;

a second input including a second controller and configured or programmed to receive a second input operation performed by the operator; and a main controller connected to the first input and the second input; wherein the first controller and the second controller are connected to each other;

the main controller is configured or programmed to be powered off when the second input does not receive the second input operation within a first length of time after the engine is stopped; and the main controller is configured or programmed not to be powered off when the second input receives the second input operation within the first length of time after the engine is stopped.

* * * * *